US009580905B2

(12) United States Patent
Le Madec et al.

(10) Patent No.: US 9,580,905 B2
(45) **Date of Patent: *Feb. 28, 2017**

(54) INSULATING PANELS MADE OF STONE WOOL, AND CONCRETE WALL PROVIDED WITH SUCH PANELS

(71) Applicant: Rockwool International A/S, Hedehusene (DK)

(72) Inventors: Bruce Le Madec, Le Plessis Robinson (FR); Frederic-Jerome Cardona, Bois le Roi (FR); Gilles Guyoton, Meriel (FR); Michel Guillon, Moureuille (FR); Ismael Baraud, Saint-Denis (FR)

(73) Assignee: Rockwool International A/S, Hudehusene (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/785,889

(22) PCT Filed: Apr. 23, 2014

(86) PCT No.: PCT/EP2014/058197

§ 371 (c)(1),
(2) Date: Oct. 21, 2015

(87) PCT Pub. No.: WO2014/173931

PCT Pub. Date: Oct. 30, 2014

(65) Prior Publication Data

US 2016/0069079 A1 Mar. 10, 2016

(30) Foreign Application Priority Data

Apr. 24, 2013 (FR) ..... 13 53731

(51) Int. Cl.
*E04B 2/00* (2006.01)
*E04F 13/08* (2006.01)
(Continued)

(52) U.S. Cl.
CPC ..... *E04C 2/44* (2013.01); *E04B 5/36* (2013.01); *E04F 13/0875* (2013.01); *E04F 13/04* (2013.01); *E04F 13/0885* (2013.01)

(58) Field of Classification Search
CPC ..... E04C 2/44; E04B 5/35; E04F 13/0875
(Continued)

(56) References Cited

U.S. PATENT DOCUMENTS 4,206,267 A * 6/1980 Jungbluth ..... E04B 7/107 428/138
4,811,770 A * 3/1989 Rapp ..... E04B 5/36 52/309.12
(Continued)

FOREIGN PATENT DOCUMENTS

EP 1 826 329 8/2007
EP 2 584 111 4/2013
(Continued)

OTHER PUBLICATIONS

Abstract of German Patent, DE2542529, Apr. 7, 1977, 1 page.
(Continued)

*Primary Examiner* — Brian Glessner
*Assistant Examiner* — Paola Agudelo
(74) *Attorney, Agent, or Firm* — Dority & Manning, P.A.

(57) ABSTRACT

Insulating panel (10) having a top face (12) and a bottom face (14) opposite the top face, comprising a body (20) made of stone wool with a part of substantially uniform first density and a part of substantially uniform second density, different from the first density, at least one profiled groove (22) being formed in said insulating panel starting from the top face, the top face (12) being made of stone wool, the groove (22) being formed in the stone wool, the number of
(Continued)

grooves being less than or equal to three for 60 cm of a dimension of said panel perpendicular to the direction of the grooves.

15 Claims, 3 Drawing Sheets

(51) Int. Cl.
*E04B 5/36* (2006.01)
*E04F 13/04* (2006.01)

(58) Field of Classification Search
USPC ..... 52/309.12, 309.11, 309.6, 314
See application file for complete search history.

(56) References Cited

U.S. PATENT DOCUMENTS 6,272,749 B1 * 8/2001 Boeshart ..... E04B 5/36 29/897.32
6,298,622 B1 * 10/2001 Cretti ..... B29C 45/14311 52/309.12
6,305,135 B1 * 10/2001 Inaba ..... B32B 3/30 52/309.12
6,817,150 B1 * 11/2004 Boeshart ..... B28B 7/0082 249/102
7,954,291 B2 * 6/2011 Cretti ..... E04B 5/19 52/309.12
8,734,691 B1 * 5/2014 Boeshart ..... E04B 5/19 264/333
9,016,027 B1 * 4/2015 Kreizinger ..... E04B 2/847 52/269
2008/0041004 A1 * 2/2008 Gibbar ..... E04C 2/288 52/309.12
2009/0165410 A1 * 7/2009 Wuts ..... E04B 1/7675 52/302.1
2010/0287860 A1 * 11/2010 Fernandez-Cano ... E04B 1/7658 52/235
2012/0102867 A1 * 5/2012 Volkner ..... E04B 1/24 52/582.1
2014/0318068 A1 * 10/2014 Jakobsen ..... E04B 1/762 52/506.05
2015/0300003 A1 * 10/2015 Jakobsen ..... E04B 1/762 52/506.05

FOREIGN PATENT DOCUMENTS

FR 857262 9/1940
FR 2 142 579 2/1973

OTHER PUBLICATIONS

Abstract of European Patent, EP1106742, Jun. 13, 2001, 2 pages.
Abstract of French Patent, FR2538432, Jun. 19, 1984, 1 page.
Abstract of French Patent, FR2624154, Jun. 9, 1989, 2 pages.
International Search Report for PCT/EP2014/058197 dated Jul. 18, 2014, 2 pages.

* cited by examiner

INSULATING PANELS MADE OF STONE WOOL, AND CONCRETE WALL PROVIDED WITH SUCH PANELS

CROSS REFERENCE TO RELATED APPLICATION

This application is the national stage entry of International Patent Application No. PCT/EP2014/058197 having a filing date of Apr. 23, 2014, which claims priority to and the benefit of French Patent No. 1353731 filed in the French Intellectual Property Office on Apr. 24, 2013, the entire contents of which are incorporated herein by reference.

The invention relates to insulating panels made of mineral wool and in particular of stone wool. It is known to use such insulating panels on the underside of a concrete wall, in particular a reinforced concrete wall, which can be placed horizontally or in a sloping manner.

It is also known to use such insulating panels as shuttering for the pouring of concrete, in particular when the concrete wall is disposed horizontally to form a ceiling.

A typical application of such panels is the thermal and acoustic insulation of reinforced concrete walls, in particular for cellar or car park ceilings located in basements of residential buildings, buildings for business use or public buildings.

In this particular application, the insulating panels are used to provide thermal and acoustic insulation of reinforced concrete ceilings between these cellars or car parks and the rooms located immediately on the floor above.

The use of panels based on mineral fibre, and especially on stone wool, means that they have good fire resistance properties and for this reason they are increasingly being used in this particular application.

Insulating panels can thus be used first as shuttering elements for the pouring of concrete, especially in the case of a horizontal slab, and then as insulation once the concrete has hardened.

The panels are first placed on a suitable shuttering plate, which is generally composed of one or more metal plates supported by girders, which are themselves supported by props or the like.

The insulating panels are then placed contiguously on the shuttering plate, and then the concrete slab is poured onto the insulating panels.

Once the concrete has hardened, the shuttering is removed.

The problem which arises is that of fixing the insulating panels to the underside of the concrete slab so that the panels remain fixed integrally to the concrete slab once the shuttering plate has been removed.

A conventional solution for fixing the panels to the underside of the concrete slab is to use anchoring elements of the helical spring or corkscrew type, as is taught by publication FR 2 624 154.

This solution requires the anchoring elements to be implanted beforehand in the insulating layer of the panels, which is then blind sunk into the concrete.

This solution has the disadvantage especially that it requires lengthy and tedious operations of fitting the anchoring elements by screwing into the thickness of the panels.

Another known solution is to provide grooves of a suitable shape in a top face of the panels, as is taught by publication EP 1 106 742.

However, this known insulating panel comprises two layers of fibres, of which one withstands pressure in one given direction and the other withstands pressure in a perpendicular direction.

Such an insulating panel is therefore particularly complicated to produce, in particular because the predominant direction of the fibres is turned by 90° in one of the layers during manufacture. Another disadvantage is the orientation of fibres perpendicular to the main surface of the panel, which gives a thermal insulation value that is impaired in the perpendicular direction. The thermal insulation value of such a panel fitted with its main surface disposed against a concrete ceiling is lower than that of a panel in which the majority of the fibres are directed in another direction, everything otherwise being equal.

The invention aims to avoid the disadvantages of the known insulating panels.

It aims more particularly to provide an insulating panel made of stone wool which can be manufactured economically and which incorporates anchoring means that do not compromise the insulating properties of the panel.

It aims also to provide such an insulating panel which has good mechanical properties, in particular properties of tensile and compressive strength.

Since such insulating panels are conventionally positioned on a shuttering plate, in most cases horizontally, it can arise that operators then need to walk on the insulating panels, for example in order to fit reinforcements to the panels.

It is therefore essential that, on such an occasion, the operators do not produce crushing or permanent deformation in the thickness of the insulating body, which might subsequently compromise the insulating properties and also the fire resistance properties.

To that end, the invention proposes an insulating panel which has a top face and a bottom face opposite the top face, comprising a body made of stone wool with a part of substantially uniform first density and a part of substantially uniform second density, different from the first density, the top face being made of stone wool, the groove being formed in the stone wool, at least one profiled groove being formed in said insulating panel starting from the top face, the number of grooves being less than or equal to three for 60 cm of a dimension of said panel perpendicular to the direction of the grooves.

Accordingly, the insulating panel comprises a body made of stone wool, the highest density part of which can be arranged above the lower density part, resulting in a high resistance to crushing. The body can be composed of two layers of stone wool. The fibres can have the same predominant direction. The predominant direction of the two layers can be parallel to the main surface, contrary to what is disclosed in EP 1 106 742.

Moreover, the applicant has found, surprisingly, that strong fixing of the insulating panels to the underside of a reinforced concrete slab can be obtained by using a limited number of profiled grooves, that is to say a number of grooves less than or equal to three for 60 cm of a dimension of the panel perpendicular to the direction of the grooves.

The small number of grooves reduces losses of material during manufacture. The small number of grooves gives good thermal insulation performances of the panel as compared with a panel having a large number of grooves.

Since a typical dimension of such insulating panels is a width of 60 cm for a length of 120 or 240 cm, it is possible, for example, to provide a single groove in the direction of the length of such a panel. In a panel of width 100 cm for a length of 120 cm, one groove can be sufficient.

In order to obtain these results, it is also important that the grooves have a cross-sectional profile in a plane perpendicular to the direction of the groove allowing the introduction of concrete, when it is poured.

It is also important that the insulating panel has sufficient mechanical strength to allow reversible deformations under the application of a force having the value indicated above, on the top face.

The grooves can have various profiles, such as, for example, a trapezoidal profile with small bases on the side of the top face, a rectangular profile, a parallelogram-shaped profile, these profiles being given by way of examples. The groove can have such a profile with a possible variation of 20° for each side with respect to the geometric shape. The groove can have such a profile with fillets which can extend to up to 50% of the depth of the groove. Accordingly, for a depth P, the fillet can have a radius up to the value P/2.

It can also be provided that the grooves have a bottom parallel to the top face and edges with unequal gradients, the width of the groove increasing towards the bottom.

In another variant, the groove has a transverse profile with a zone of small width close to the top face and a zone of large width at a distance from the top face.

As already mentioned, it is possible to provide a single longitudinal groove per panel, for example for a panel width of from 50 to 70 cm. Accordingly, a panel of width 70 cm having one longitudinal groove has a number of grooves for 60 cm equal to 0.86.

In a variant embodiment, the panel is provided with two longitudinal grooves for a width of from 50 to 70 cm.

The depth of the groove is from 0.5 to 6 cm, and preferably from 1 to 4 cm. An advantage of the small groove depth is that the flexural strength of the panel, which is an important parameter in order to be able to handle the panel easily during fitting, is substantially preserved as compared with a solid panel. Surprisingly, it has been observed that the preferred range offers sufficient tensile strength in the fitted state after hardening of the concrete poured onto the panel. The tension is understood to be perpendicular to the top face of the panel. In other words, the tension corresponds to a downward pull.

Here, the depth is relatively small compared with what had been envisaged previously.

The minimum width of the groove, in a zone closer to the top face than to the bottom of the groove, is advantageously greater than or equal to 15 mm, preferably 25 mm.

In one embodiment, a groove is formed between two contiguous panels, each panel being provided with a half-groove. The groove is formed after the two panels have been positioned edge to edge. The shape of the groove formed by the two half-grooves is identical to the shape of the groove described above. The shape of the groove formed by the two half-grooves can be chosen from the groove shapes described above.

The first stone wool density is advantageously from 100 to 300 kg per $m^3$, preferably from 110 to 180 kg per $m^3$. The second stone wool density is advantageously from 60 to 120 kg per $m^3$, preferably from 80 to 105 kg per $m^3$.

The meaning of "substantially uniform density" is the same as for a mineral-wool-based insulating panel manufactured by a conventional process. Such a process is described in EP 794928, to which the reader is referred.

Particles can be present in a product obtained by said process, especially in order to improve the resistance to fire. The particles can be added during manufacture. The insulating panel comprising such particles has a substantially uniform density overall, despite the fact that the particles can have, locally, a density that is different from the density of the mineral wool surrounding the particles. The particles can comprise magnesium oxide containing water.

Furthermore, a layer can be applied to the insulating panel during or after manufacture, the layer having a density that is independent of the density of the mineral wool of the body. The layer can be provided for decorative purposes. The layer can be produced on the basis of mortar or plaster.

Said insulating panel can have a mechanical strength that is sufficient to allow reversible deformations under the application of a pressure having a value of from 1.5 to 5.0 Newtons/$cm^2$ on the top face.

In one embodiment, the top face forms a face of the part of first density and the bottom face forms a face of the part of second density.

Accordingly, below the pressure specified, the deformation of the panel is elastic. The panel regains its former shape after the pressure has stopped.

In another aspect, the invention relates to a concrete insulating wall comprising a concrete slab provided with insulating panels as defined above, said panels being fixed to a bottom face of the concrete slab by introducing the concrete into the grooves of said insulating panels.

In another aspect, the invention relates to a cellar ceiling comprising such an insulating wall.

It will be understood that this concrete wall can be a horizontal wall when it is, for example, a ceiling, or a sloping wall, for example when such a wall is on an underside, of a banister, of tiers, etc. The slope of the wall can be from 0° to 90° relative to a horizontal direction.

In the detailed description which follows, which is given only by way of examples, reference is made to the accompanying drawings in which.

Figure 1:
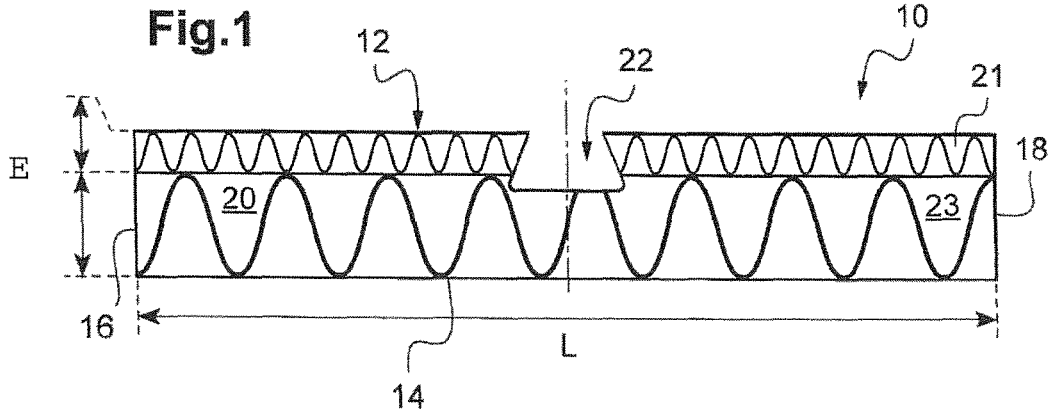
FIG. 1 is a transverse sectional view of an insulating panel provided with a single profiled groove that opens out into a top face of said panel.

Reference will first be made to FIG. 1, which shows a sectional view of an insulating panel 10 having a top face 12 and a bottom face 14 opposite the top face. The faces 12 and 14 are rectangular in shape and are parallel to one another. The insulating panel 10 has a width L between two longitudinal edges 16 and 18. The panel has a thickness E as defined by the distance between the faces 12 and 14. The top face 12 has a roughness which is a function especially of the density of the material. The top face 12 can further have longitudinal undulations, especially of amplitude less than 2 mm. The longitudinal undulations can have a wavelength of from 5 to 30 mm. Said undulations can result from the hardening of the panel during manufacture. Hardening is carried out in a baking kiln, certain elements of which can be in contact with the panel. The profile of the baking kiln can print a pattern in the panel, which pattern remains after hardening.

This panel comprises a body 20 made of mineral wool, in this case stone wool.

The body 20 is composed of two layers, a top layer 21 and a bottom layer 23. The top layer 21 has a density that is substantially uniform in the thickness direction, for example from 100 to 300 kg per $m^3$ and more advantageously from 110 to 180 kg/$m^3$ (for example 150 kg/$m^3$) with the usual manufacturing tolerances. The bottom layer 23 has a density that is substantially uniform in the thickness direction, for example from 60 to 120 kg per $m^3$ and more advantageously from 80 to 105 kg/$m^3$ (for example 95 kg/$m^3$) with the usual manufacturing tolerances. The density uniformity is within 10%. The top face 12 is made of stone wool. The top face 12 also belongs to the body 20.

The body 20 can act as insulation for the panel 10. The panel 10 can further comprise a coating on the bottom face 14, for example based on plasterboard, mortar, decorative elements, etc. In one embodiment, the insulating panel 10 is a two-layer panel.

The top layer 21 can have a thickness of from 10 to 30 mm (for example 25 mm). The bottom layer 23 can have a thickness of from 10 to 290 mm.

The panel 10 can be produced by a known process starting from, for example, rock to form fibres which are generally oriented in a preferential direction.

The width L of the panel is typically 60 cm for a length of 120 or 240 cm, or 100 cm for a length of 120 cm.

As can be seen in FIG. 1, a profiled groove 22 is formed in the insulating panel starting from the top face 12. The groove 22 opens out onto this top face. The groove 22 is formed in the stone wool. The groove 22 is located in the body 20. The profiled groove 22 crosses the top layer 21 and partly enters the bottom layer 23.

The thickness E of the panel can be, for example, from 40 to 300 mm and more advantageously from 50 to 300 mm.

In the example shown, the insulating panel comprises a single groove for 60 cm of a dimension, that is to say for 60 cm of width.

More generally, the number of grooves can be less than or equal to 3 for 60 cm of a dimension of said panel perpendicular to the direction of the grooves.

There can accordingly be provided a single longitudinal groove as in the case of FIG. 1, for a width of from 50 to 70 cm.

However, it is also possible to envisage, within the scope of the invention, an arrangement of grooves in the transverse direction, provided that the number of grooves is less than or equal to 3 for 60 cm of a dimension.

In the example of FIG. 1, the groove 22 has a trapezoidal profile, the small base of which is on the side of the top face and the large base is on the opposite side, as will be seen in detail below.

Moreover, the insulating panel 10 has a mechanical strength that is sufficient to allow reversible deformations under the application of a pressure having a value of from 1.5 to 5.0 Newtons/$cm^2$ on the top face, considering the effect of a foot of a person walking on the panel. By way of example, the maximum value of the pressure can be from 2.6 to 3.1 Newtons/$cm^2$.

Figure 2:
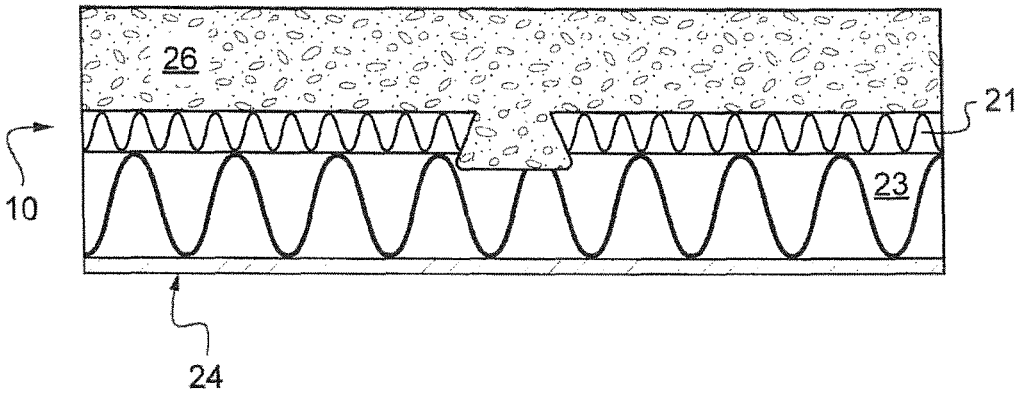
FIG. 2 shows the panel of FIG. 1 disposed horizontally on a shuttering plate, and onto which a concrete slab has been poured.

Reference will now be made to FIG. 2, which shows the use of the panel 10 of FIG. 1 as a shuttering element.

The panel 10 is placed horizontally on a shuttering plate 24 formed of one or more metal plates disposed on support members (not shown) used in the conventional manner.

Conventionally, such metal plates are supported by parallel girders, which are placed at the top of suitable props.

After the insulating panel, which is actually a plurality of insulating panels disposed contiguously, has been put in place, concrete is poured to form a concrete slab 26 above the insulating panel. This concrete slab can have a thickness of, for example, from 14 to 23 cm, generally 14, 18 or 23 cm.

Conventionally, the concrete is reinforced, that is to say reinforcements (not shown) are provided above and at a distance from the top face 12 of the panels.

Because the insulating panel has suitable mechanical strength, as indicated above, the panel allows reversible deformations under the application of a pressure having the indicated value.

As a result, if an operator occasionally needs to walk on the panels, for example in order to fit reinforcements, these deformations will be reversible and will subsequently not impair either the thermal insulation properties or the fire resistance properties.

When the concrete is poured, it will fill the grooves 22 of the insulating panels.

Accordingly, once the concrete has hardened, the shuttering plate 24 can be removed, the insulating panels 10 remaining integrally fixed underneath the concrete slab.

The profiled grooves are hence each filled with a concrete bar having a complementary profile, which creates a mechanical lock by shape cooperation.

Figure 3:
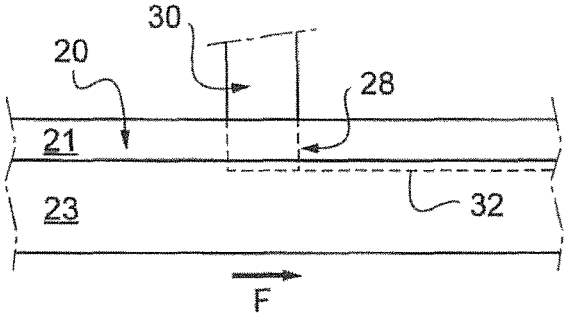
FIG. 3 shows a partial view of two sides, a body made of stone wool during manufacture, in which the profiled groove is formed by means of a tool.

Reference will now be made to FIG. 3, which shows the manufacture of a body 20 made of stone wool. The body 20 is displaced horizontally in the direction of the arrow F by suitable transport means, for example by endless conveyor belts disposed beneath and above the moving body 20.

According to the invention, a cutting tool 28 carried by a support 30 is provided, the cutting tool being driven into the thickness of the insulating body in order to produce a profiled groove 22 as the body made of stone wool is displaced. For a panel having a plurality of grooves, a corresponding number of cutting tools 28 on individual supports or on one common support is employed.

The cutout of the profiled groove is shown schematically by the broken line 32 in FIG. 3.

Figure 4:
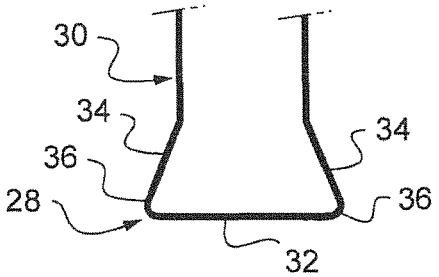
FIG. 4 is a front view of the tool of FIG. 3.

Reference will now be made to FIG. 4, which shows in profile view the cutting tool 28 connected to the support 30.

Here, the cutting tool 28 is to be driven into the body 20 made of stone wool, while the support 30 is disposed above the body while being connected to a suitable fixed structure.

Here, the cutting tool is produced in the form of a knife having a suitable profile to give the groove 22 a trapezoidal profile. Accordingly, the tool 28 comprises a large base 32 and two sloping sides 34 which are themselves connected to the support 30. The base 32 and the sides 34 are connected by rounded portions 36.

The formation of the profiled groove or grooves is preferably carried out by means of a cutting tool such as a knife, or a milling cutter.

However, it is also within the scope of the invention to use other types of tool, for example saws, etc.

Figure 5:
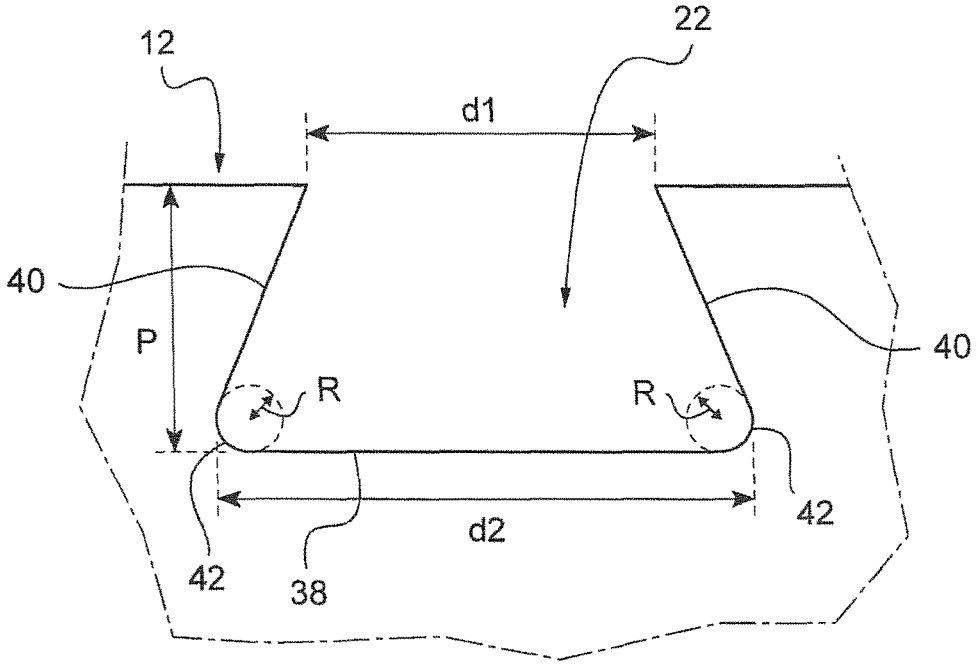
FIG. 5 is a detailed view on an enlarged scale of one embodiment of a profiled groove.

FIG. 5 shows a groove 22 having a trapezoidal profile analogous to that of FIGS. 1 and 2.

The groove has a bottom 38 parallel to the top face 12 and edges 40 with equal gradients.

The groove 22 accordingly has a transverse profile having a zone of small width (d1) close to the top face 12 and a zone of large width (d2) at a distance from the top face. The distance d1 corresponds to the width of the groove in the plane of the top face, that is to say corresponding to the small base of the trapezium, while the distance d2 corresponds to the width of the groove at the bottom 38.

By way of example, the value d1 can be from 1.5 to 5 cm, for example 3 cm, and the value d2 can be from 3 to 8 cm, for example 6 cm.

The depth of the groove 22 is advantageously from 0.5 to 6 cm, and preferably from 1 to 4 cm.

It has been found that such a depth for such a small number of grooves allowed the desired strength performances to be obtained.

As can also be seen in FIG. 5, the bottom 38 is connected to the edges 40 by rounded portions 42 having a radius of from 3 to 15 mm, preferably from 5 to 6 mm.

Figure 6:
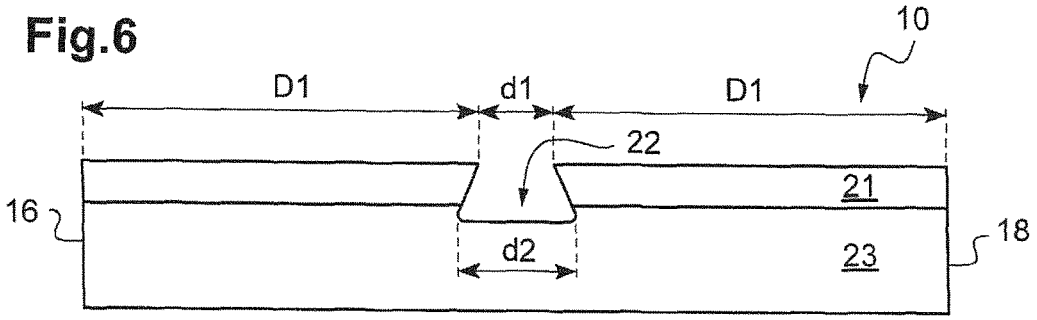
FIG. 6 is a view analogous to FIG. 1 showing dimensions.

FIG. 6 is a sectional view analogous to FIG. 1. It will be seen that the profiled groove 22 is at an equal distance D1 from the edges 16 and 18 of the panel 10.

It will be seen that the profiled groove 22 is at an equal distance D1 from the edges 16 and 18.

This distance D1 is equal to ½ (L−d1).

Figure 7:
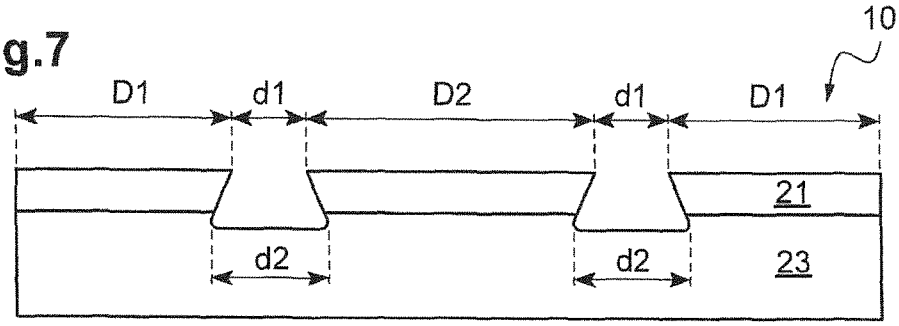
FIG. 7 is a view analogous to FIG. 6 in which the insulating panel comprises two profiled grooves.

FIG. 7 shows a variant embodiment in which the insulating panel comprises two profiled grooves 22 analogous to those described above. This profiled groove has the same dimensions as those of the preceding figures.

Each of the grooves is situated at a distance D1 from a longitudinal edge, the distance between the two grooves being equal to D2.

By way of example, D1 and D2 can have the following values, respectively: 13.5 and 27 cm for a groove width in the plane of the top face equal to 3 cm and a panel width equal to 60 cm.

Figure 8:
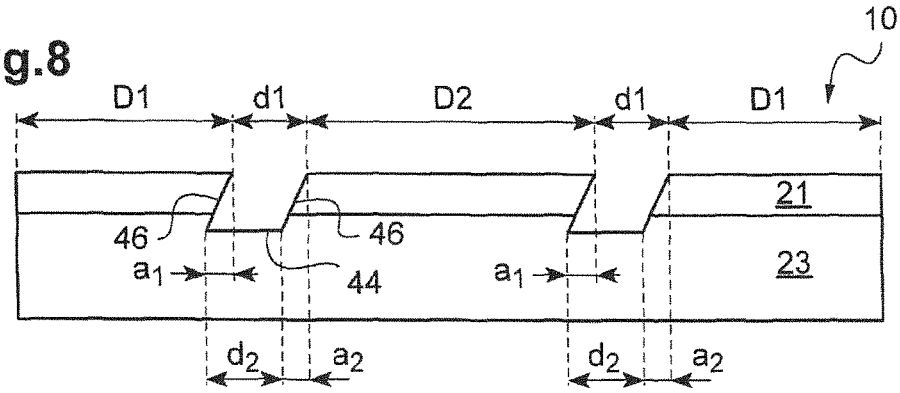
FIG. 8 shows a variant embodiment in which the insulating panel comprises two profiled grooves with different profiles.

FIG. 8 shows a variant embodiment in which the grooves have a parallelogram-shaped profile. Each groove has a bottom 44 and two sides.

FIG. 8 shows the displacements a1 and a2 of the ends of the bottom 44 relative to the opening. By way of example, a1 and a2 can be less than 1.5×P, where P is the depth of the groove, advantageously less than or equal to 0.75×P. Here a1=a2. In another embodiment, a1>a2.

Figure 9:
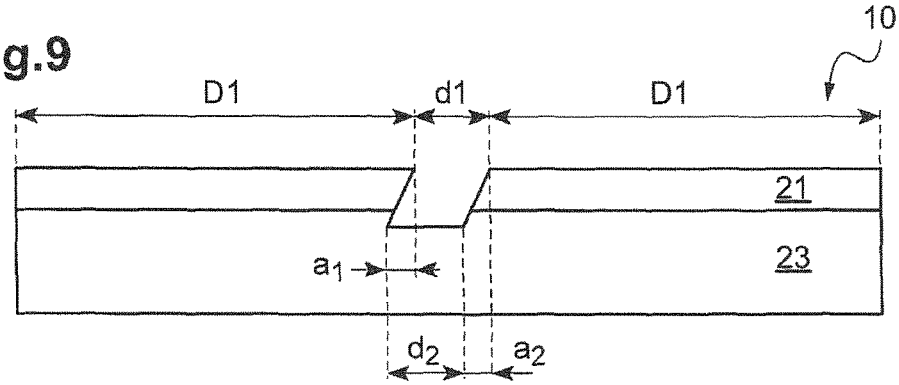
FIG. 9 shows a sectional view of an insulating panel comprising a single profiled groove with a profile different from that of FIGS. 1 and 6.

FIG. 9 shows a variant embodiment of FIG. 8 in which the panel comprises a single groove having a parallelogram-shaped profile.

In general, in order to ensure good anchoring, it is preferable that the grooves have a bottom that is parallel to the top face with edges of unequal or equal gradient, the width of the groove increasing towards the bottom.

Other profile shapes are possible, including a rectangular profile. The rectangular profile can be sloping relative to the top face. The rectangular profile is then truncated by the top face.

In addition, the minimum width (d1) of the groove in a zone closer to the top face than to the bottom of the groove is generally greater than or equal to 15 mm.

It is necessary for the minimum width of the groove to be broadly larger than the maximum size of the granules that are included in the composition of the concrete so that such granules cannot impede the introduction of the concrete into the grooves.

The invention is accordingly used in the insulation of concrete walls, whether they be horizontal or sloping.

Tests have been carried out on insulating panels and have yielded the following result:

1) Tensile Strength

Tests have been carried out in order to compare the tensile strength of the profiled groove of the invention with anchoring members such as helical or corkscrew elements as described in publication FR 2 624 154.

The minimum value obtained in these results has shown that the behaviour was at least seven times superior to that of a panel of the prior art, with only one groove per panel, that is to say one groove for a panel dimension of 60 cm perpendicular to the groove.

It was also observed that, due to the shape of the profiled groove, the strength remained effective subsequently because, in addition, the sloping edges of the profile of the groove prevented the concrete from subsequently coming away after adhesion between the concrete and the insulation was lost.

The tensile strength test is different from the standard test. The difference lies in the fact that, in the standard test, tension from the test equipment is exerted over the whole surface area (0.3×0.3 m), while in the test of the invention, the tension is exerted only over the surface area of the groove, that is to say over a smaller surface area. An attempt has therefore been made to identify and adapt the effect brought about by the groove. The minimum value obtained is therefore a lower bound of the value under real conditions. The test is carried out according to standard EN 1607. The results obtained are as follows for a ROCKFEU DUAL "RAINURE" ("GROOVE") panel, dovetailed or parallelogram-shaped, with depths 40, 40, 60 and 40 mm, groove head widths 50, 30, 50 and 50 mm, groove bottom widths 80, 60, 80 and 50 mm (with displacements a1 and a2 of 20 mm), respectively:

| ROCKFEU DUAL "RAINURE" ("GROOVE") | | |
|---|---|---|
| | Pulling load ($daN/m^2$) | Improvement factor |
| Series 1 (ROCKFEU RAINURE Dual Queue d'Aronde (Dovetail) - 40/50/80) | | |
| average | 266.9 | 7 |
| min | 264.0 | 7 |
| Series 2 (ROCKFEU RAINURE Dual Queue d'Aronde (Dovetail) - 40/30/60) | | |
| average | 395.9 | 10 |
| min | 258.0 | 7 |
| Series 3 (ROCKFEU RAINURE Dual Queue d'Aronde (Dovetail) - 60/50/80) | | |
| average | 485.7 | 13 |
| min | 382.0 | 10 |
| Series 4 (ROCKFEU RAINURE Dual Biseau (Bevel) - 40/50/20) | | |
| average | 521.0 | 14 |
| min | 444.0 | 12 |

The density of the tested product ROCKFEU DUAL "RAINURE" ("GROOVE") is 150 $kg/m^3$ in the top layer and 95 $kg/m^3$ in the bottom layer. The thermal conductivity is 36 $mWm^{-1}K^{-1}$.

The conducted test is a suitable parameter for determining the tensile strength. Given that concrete is much stronger than mineral wool and that the horizontal surfaces constitute the weakest parts of the interface between the mineral wool and the concrete, the test can be considered to be representative and satisfactory.

2) Compressive Strength

The compression value obtained on ungrooved samples is at least 20 kPa, a comparable value being expected on grooved samples. The standard test is EN 826 for a non-laminar product expressed according to a compressive stress at 10% deformation. The compression test values are measured on an ungrooved panel.

3) Concentrated Loads

The usual testing tool for solid panels is found to be unsuitable for a grooved panel because the dimensions of the bearing surface of the testing tool are very similar to the width of the groove. Nevertheless, the results obtained are sufficient and convincing with a value of 213 N at the groove for a dovetailed ROCKFEU DUAL "RAINURE" ("GROOVE") panel, depth 40 mm, groove head width 30 mm, groove bottom width 60 mm, and a value greater than 300 N outside the groove. The test was conducted according to standard EN 12430.

The density of the tested product ROCKFEU DUAL "RAINURE" ("GROOVE") is 150 kg/m$^3$ in the top layer and 95 kg/m$^3$ in the bottom layer. The thermal conductivity is 36 mWm$^{-1}$K$^{-1}$.

4) Flexural Strength

The density of the tested product ROCKFEU DUAL "RAINURE" ("GROOVE") is 150 kg/m$^3$ in the top layer and 95 kg/m$^3$ in the bottom layer. The thermal conductivity is 36 mWm$^{-1}$K$^{-1}$. The tests were carried out according to standard EN 12089.

There is no significant difference between the ungrooved products of the prior art and the grooved products of the invention. The panel can be handled by an operator accustomed to conventional panels.

The insulating panel of the invention can accordingly be used on undersides or on concrete, regardless of the orientation thereof. This can be not only ceilings but also sloping walls such as, for example, walls located beneath staircases, beneath tiers, etc.

The invention claimed is:

1. An insulating panel having a top face and a bottom face opposite the top face, comprising a body made of stone wool with a part of substantially uniform first density and a part of substantially uniform second density, different from the first density, at least one profiled groove being formed in said insulating panel starting from the top face, the top face being made of stone wool, the groove being formed in the stone wool, the number of grooves being less than or equal to three for 60 cm of a dimension of said panel perpendicular to the direction of the grooves, wherein the groove has a depth of from 0.5 to 6 cm, and wherein the first stone wool density is from 100 to 300 kg per cubic meter and the second stone wool density is from 60 to 120 kg per cubic meter.

2. The insulating panel of claim 1, wherein the groove has a trapezoidal profile with a small base on the side of the top face.

3. The insulating panel of claim 1, wherein the groove has a rectangular profile.

4. The insulating panel of claim 1, wherein the groove has a parallelogram-shaped profile.

5. The insulating panel of claim 1, wherein the groove has a bottom parallel to the top face and edges of unequal gradients, the width of the groove increasing towards said bottom.

6. The insulating panel of claim 1, wherein the groove has a transverse profile with a zone of smaller width close to the top face and a zone of larger width at a distance from the top face.

7. The insulating panel of claim 1, provided with one longitudinal groove for a panel width of from 50 to 70 cm.

8. The insulating panel of claim 1, provided with two longitudinal grooves for a panel width of from 50 to 70 cm.

9. The insulating panel of claim 1, wherein the depth of the groove is from 1 to 4 cm.

10. The insulating panel of claim 1, wherein the minimum width of the groove, in a zone closer to the top face than to the bottom of the groove, is greater than or equal to 15 mm.

11. The insulating panel of claim 1, wherein the first stone wool density is from 110 to 180 kg per cubic meter and the second stone wool density is from 80 to 105 kg per cubic meter.

12. The insulating panel of claim 1, wherein the panel allows reversible deformations under the application of a pressure having a value of from 1.5 to 5.0 Newtons/cm$^2$ on the top face.

13. The insulating panel of claim 1, wherein the top face forms a face of the part of first density and the bottom face forms a face of the part of second density.

14. Concrete insulating wall, comprising a concrete slab and insulating panels according to claim 1, wherein the insulating panels are fixed to a bottom face of the slab by introducing concrete into the groove or grooves of the insulating panels.

15. Cellar ceiling comprising an insulating wall according to claim 14.

* * * * *